United States Patent [19]

Haskins

[11] 4,359,611

[45] * Nov. 16, 1982

[54] MODULAR SWITCH

[75] Inventor: Steve W. Haskins, Corinth, Miss.

[73] Assignee: Northern Telecom, Inc., Nashville, Tenn.

[ * ] Notice: The portion of the term of this patent subsequent to Mar. 9, 1977, has been disclaimed.

[21] Appl. No.: 171,184

[22] Filed: Jul. 22, 1980

[51] Int. Cl.[3] ..... H01H 9/02

[52] U.S. Cl. ..... 200/1 TK; 200/303; 200/307; 200/339

[58] Field of Search ..... 200/1 R, 1 A, 1 TK, 200/6 R, 6 B, 6 BA, 6 BB, 243, 246, 247, 248, 249, 250, 283, 284, 302, 303, 307, 325, 339

[56] References Cited

U.S. PATENT DOCUMENTS

| | | | |
|---|---|---|---|
| 3,221,131 | 11/1965 | Bury | 200/307 |
| 3,555,229 | 1/1971 | Britton et al. | 200/249 |
| 3,971,904 | 7/1976 | Ward | 200/303 X |
| 4,024,362 | 5/1977 | Morgan et al. | 200/339 X |
| 4,144,430 | 3/1979 | Coldren et al. | 200/246 X |
| 4,179,593 | 12/1979 | Tsunefuji | 200/325 X |
| 4,319,107 | 3/1982 | Haskins | 200/303 |

*Primary Examiner*—James R. Scott

*Attorney, Agent, or Firm*—Schwartz, Jeffery, Schwaab, Mack, Blumenthal & Koch

[57] ABSTRACT

A modulator switch, adapted for telecommunication purposes, has a hollow body within which are a plurality of cantilever contact members, there being a center contact member and at least one side contact member. The center contact is biased towards one side or the other and has an extension actuated by an actuator rotatably mounted on the body. Actuation to make, break or transfer contact can be provided. The switch can be designed for sliding on a cover or another switch. The particular selection of two, or three contacts provides the particular actuation required.

20 Claims, 13 Drawing Figures

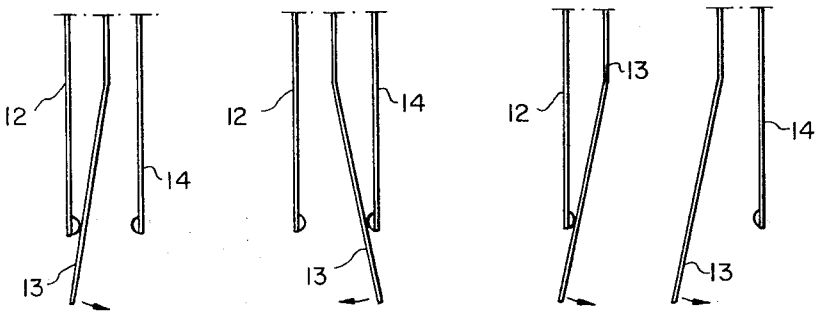
FIG. 11a
FIG. 11b
FIG. 12a
FIG. 12b
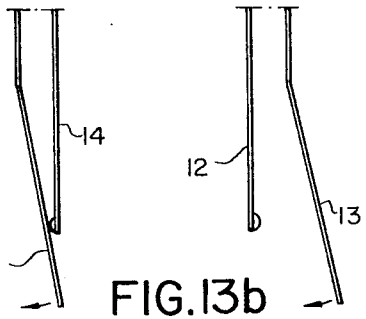
FIG. 13a
FIG. 13b
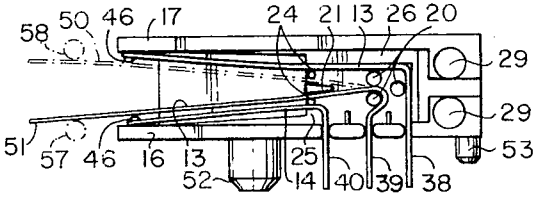
Fig 4
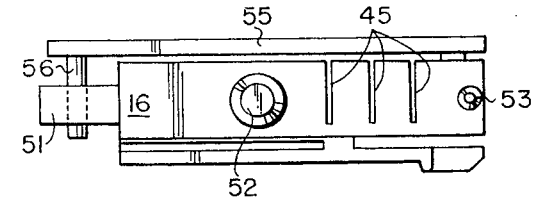
Fig 5
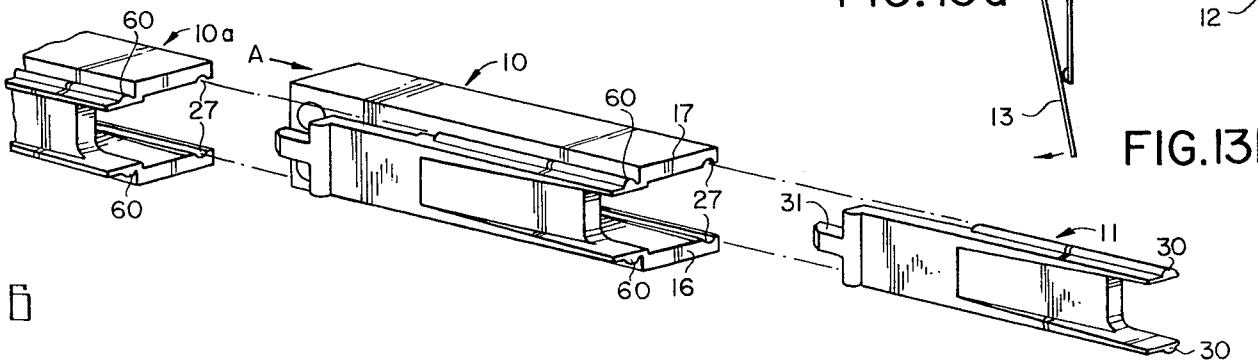
Fig 6

MODULAR SWITCH

BACKGROUND OF THE INVENTION

This invention relates to modular switches and more particularly to a modular switch for telephone lines and telecommunications generally.

SUMMARY OF THE INVENTION

A feature of the present invention is that the direction of actuation, or operation, of the switch can be pre-selected, on assembly. Further, the switch can be operated from one closed condition to another, from closed to open, or from open to closed, again by pre-selection on assembly. A further feature provides for a multiple of switches to be assembled into a unit, with each switch having the same, or different operating characteristics. Two particular forms of a switch are described and illustrated, one being of "open" formation, the other enclosed.

BRIEF DESCRIPTION OF THE DRAWINGS

The invention will readily be understood by the following description of certain embodiments, by way of example, in conjunction with the accompanying drawings, in which:

FIGS. 4 and 5 are side view and base plan view respectively of a body part and contacts as in FIG. 2, with an actuating member indicated in FIG. 5.

FIG. 6 is an exploded perspective view of the main body part and cover as in FIGS. 1 to 3, showing the back face of the body part and a partial view of a further body part positioned to be assembled to the first body part;

FIGS. 11–13 diagrammatically illustrate the various alternative contact arrangements possible with the embodiments.

DETAILED DESCRIPTION OF PREFERRED EMBODIMENTS

Figure 1:
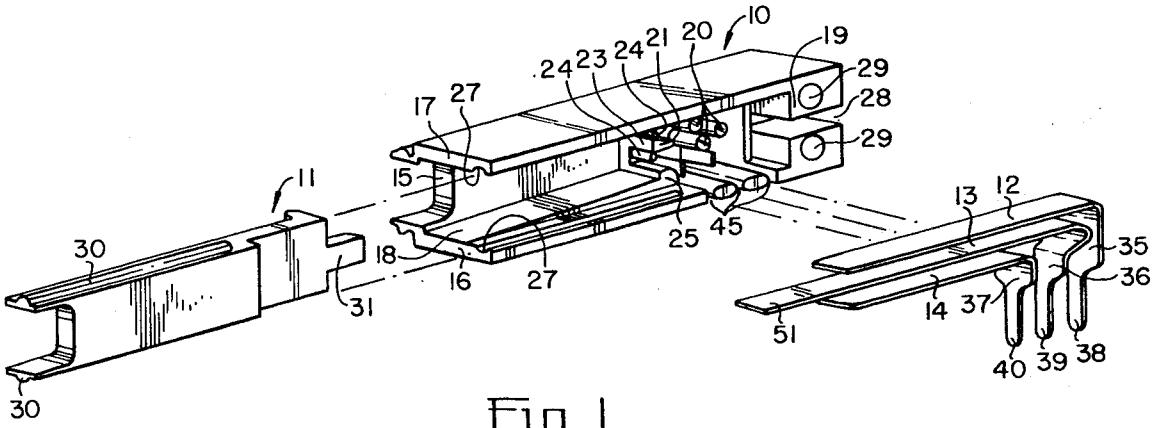
FIG. 1 is an exploded perspective view of the basic switch parts of one embodiment.

Considering first FIG. 1, there is illustrated a body part generally indicated at 10, a front cover generally indicated at 11 and a plurality of contacts, in the present example three contacts 12, 13 and 14.

The body part 10 is of channel formation having a back web 15, side members 16, 17, an open end 18 and a substantially closed end 19. Towards the closed end 19 are three cylindrical pins 20 extending forward from and normal to the back web 15. To one side of the pins 20, remote from the closed end 19, is a wedge shaped member 21 facing toward the open end 18. On either side of the wide end of the wedge shaped member 21 is a further pin 24. A transverse rib 25 is formed on the bottom side member 16 and an extended flat portion 26 is formed on the top side member 17, as will be seen in FIG. 4, which also shows the pins 20, wedge 21, pins 24 and rib 25.

In the inner surfaces of the side members 16 and 17 are formed longitudinal grooves 27 near the forward edges of the side members. The closed end 19 has a groove 28 extending therethrough and two holes 29 extend into the closed end.

The cover 11 is of a width to slide between the side members 16 and 17 of the body part 10 and has a longitudinally extending rib 30 on each edge. The ribs 30 are adapted to slide in the grooves 27 in the side members 16 and 17. An extension 31 at one end of the cover enters the groove 28 when the cover is assembled to the body member.

Figure 2:
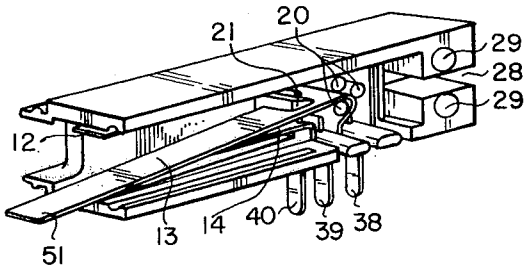
FIG. 2 is a perspective side view of the assembly of a main body part and contacts as illustrated in FIG. 1.

The contacts 12, 13 and 14 have bent down tail portions 35, 36 and 37 respectively, which are reduced in width at 38, 39 and 40 to provide terminal portions to which wires can be soldered, crimped, wire-wrapped or otherwise attached. The tail portions 35, 36 and 37 extend through slots 45 in the bottom side member 16. The positioning of the contacts 12, 13 and 14 is seen in FIGS. 2 and 4. What can be referred to as the top outer contact, contact 12, fits behind the rearmost pin 20 and over the topmost pin 30, against the flat portion 26 on the inside of the top side member 17 and over top pin 24. This contact extends to just within the open end of the body member 10. The bottom outer contact, contact 14, extends between the bottom pin 24 and the rib 25 and again extends to just within the open end of the body member 10. The free, or cantilevered, ends of the contacts 12 and 14 are given domed contact areas 46.

Figure 3:
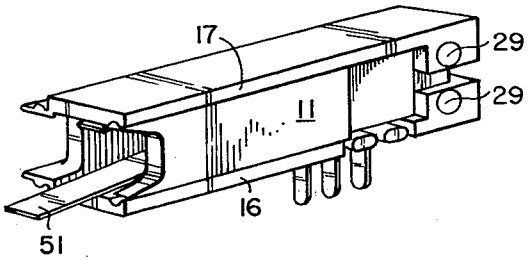
FIG. 3 is a perspective side view of the body part, contacts and a cover as illustrated in FIG. 1, assembled together.

The center contact, contact 13, can be assembled to the body portion 10 in either of two positions, with the main part of the contact on one side or the other of the wedge 21. In the drawings, in FIGS. 2, 3 and 4, the contact 13 is assembled to pass below the wedge 21, but the alternative position is illustrated in FIG. 4 in dotted outline at 50. The contact passes around bottom pin 20 below the top pin 20 and then beneath the wedge 21. The free or cantilevered end of the contact 13 is extended, at 51, and extends beyond the open end of the main body 10 for operation or actuation by an actuating member. As seen in FIG. 4, by passing beneath the wedge 21 the center contact 13 is biased towards the bottom contact 14. If passed above the wedge 21 the center contact 13 is biased towards the top contact 12. When the contacts are in position, cover 11 is slid into position. Extending from the outer surface of the bottom side member 16 are two cylindrical dowels. These dowels position the switch on, for example, a circuit board, with the tail portions 38, 39 and 40 passing through the board also.

FIG. 5 illustrates an actuator 55 pivotally mounted on the body part, typically in one of the holes 29. In the present example, the center contact 13 is to be moved upward, away from the bottom contact 14 to the upper contact 12. Therefore a lateral member 56, at the end of the actuator 55, passes beneath the extended end 51 of the center contact 13. This is indicated by the dotted circle 57 in FIG. 4. Upward pivotal movement of the actuator 55 may be accomplished in a variety of ways, and may for example, be directly operated by a handset, as a hook switch. Remote actuation is also possible. In FIGS. 5, and 4, the actuator 55 can be mounted in the bottom hole 29. When the center contact 13 is in the alternative assembled position, as illustrated by the dotted outline 50, then the actuator 55 can be mounted in the top hole 29 and the extension 56 will be above the extension 51 of the contact 13, as indicated by dotted circle 58 in FIG. 4.

FIG. 6 illustrates the rear side of the back web 15 of the body part 10. The rear side is shaped to reproduce the shape of the cover 11, by having a thickened portion with ribs 60 which correspond to ribs 30 on the cover. An extension 61 corresponds to extension 31. A further body part is indicated generally at 10*a* and it is possible to assemble body part 10*a* to body part 10 by sliding it in the direction of the arrow A. The ribs 60 engage in the grooves 27. A plurality of such body parts can be assembled together by slidingly assembling body parts one to another. One cover 11 is required to enclose the one end body part.

FIGS. 7, 8, 9 and 10 illustrate an alternative embodiment which is enclosed. The embodiment of FIGS. 1 to 6 is not completely enclosed in that the, or each body part 10 has an open end 18, and therefore dirt and undesirable foreign matter can get in. With the embodiment of FIGS. 7 to 10 this problem or disadvantage is avoided.

In the embodiment of FIGS. 7 to 10, there is a body generally indicated at part 65, a cover generally indicated at 66, contacts 67, 68 and 69, and an actuating member generally indicated at 70. The body part 65 is of channel formation having two side members 71 and 72 extending forward from a back web 73, not seen in FIG. 7 but seen in FIG. 10. The body part 65 is closed at one end, for convenience referred to as the bottom end, by web 74. At the other top end of the body part 65 the back web is extended, at 75 and there are two arcuate extensions of the side members 71 and 72, indicated at 76 and 77. The interior surfaces of the arcuate extensions 76 and 77 define a cylindrical opening 78.

The actuator 70 has a cylindrical portion 79 which is a sliding and rotating fit in the cylindrical opening 78. The portion 79 has an upward extending rib 80 from either side of which extends an arcuate shroud 81. Arcuate shroud 81 is a fairly close fit on the outside of the extensions 76 and 77. A lever 82 extends upwards from the shroud. A downward extending rib or web 83, extends into the body part 65 when the actuator is assembled to the body part.

Figure 7:
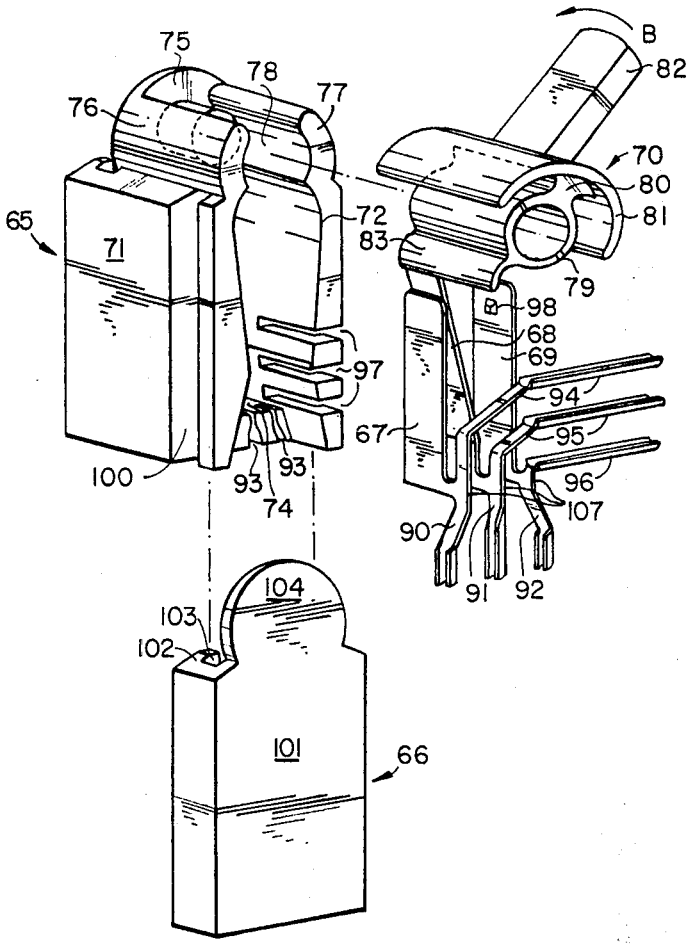
FIG. 7 is an exploded perspective view of the switch parts for another embodiment.

The contacts 67, 68 and 69 are positioned in the body part and in the particular embodiment illustrated have two sets of terminal extensions at right angles. These contacts have first terminal extensions 90, 91 and 92 which extend downwards through slots 93 in the bottom end of the body part 65 and also second terminal extensions 94, 95 and 96 extending laterally through slots 97 in side member 72. The terminal extensions position and retain the contacts in their positions in the body part. The contacts 67 and 69 can be given domed contact portions, as indicated at 98 for contact 69. In the embodiment illustrated the center contact 68 is biased to the left, normally in closed condition with contact 67. The rib or web 83 is on the left hand side of the center contact 68, the actuator thus biased in a clockwise direction, as seen in FIG. 7. On movement of the lever 82, noting arrow B, the actuator 70 rotates and rib 83 moves contact 68 away from contact 67 and into a make or closed condition with contact 69. The lever 82 can be actuated directly or indirectly, as desired. Thus, as a telephone set hook switch lever 82 can have an extension which extends up out of the telephone set base for actuation by the handset. Alternatively remote actuation can be provided.

Figure 10:
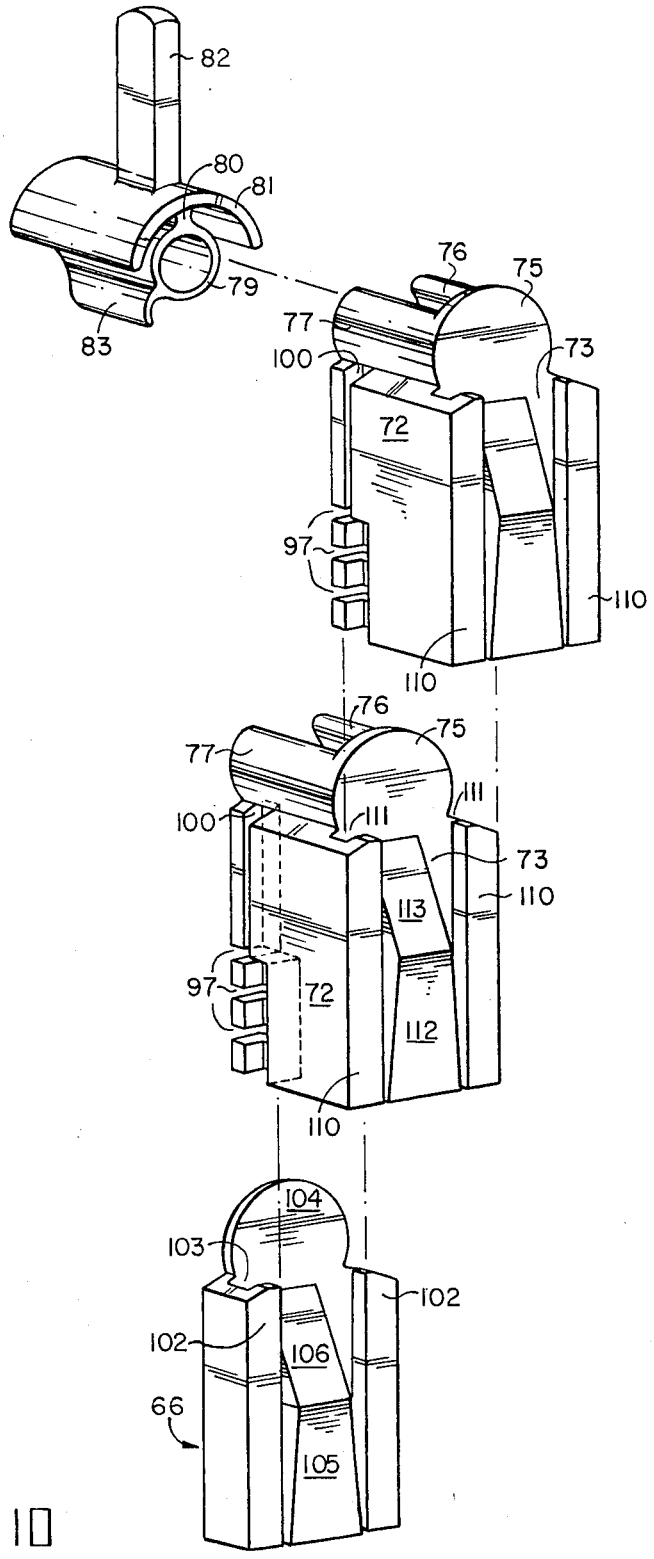
FIG. 10 is an exploded perspective view of a first body part, cover and actuating member, as in FIG. 7, looking on the rear surface of the body part, and illustrating a further body part positioned to be assembled to the first body part.

The side members 71 and 72 have grooves 100 extending from the bottom end up to the arcuate extensions 76 and 77, rear their forward edges. The cover 66 has a main web portion 101 with a rib 102 along each side edge, the ribs being undercut at 103. The cover also has an extension at an upperend at 104. When the contacts and actuation have been assembled, the cover is slid on from the bottom, the ribs 102 engaging in the grooves 100. The extension 104 closes the end of the opening 78. As seen in FIG. 10 the inner face of the cover 66 has a thick rib 105 with an inclined upper end, 106. The rib 105 rests against the portions 107 of the contacts 67, 68 and 69 to ensure that the contacts are in position.

Figure 8:
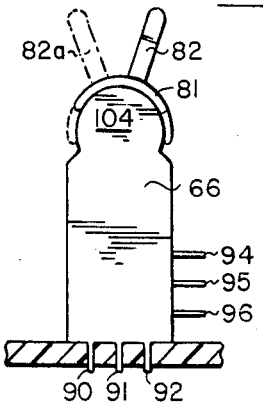
FIGS. 8 and 9 are diagrammatic front views of a switch as in FIG. 7, illustrating alternative mounting positions operating directions.
Figure 9:
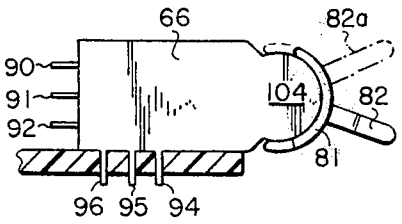

The switch can be mounted in two positions, on its bottom end, as illustrated in FIG. 8, or on its side as illustrated in FIG. 9, with the related terminal extensions passing through the mounting member, for example a circuit board. As with the embodiment illustrated in FIGS. 1 to 6, the central contact can be reversed. However, in the present example, the central contact 68, as illustrated in FIG. 7, would be replaced by a contact bent to the right and normally in a closed condition with contact 69. The rib or web 83 would then be positioned to the right of the contact and actuation would be by anticlockwise rotation of the actuator, as viewed in FIG. 7. This is indicated in FIGS. 8 and 9, which are views on the cover, the position of lever 82 for the contact arrangement of FIG. 7 being shown in full outline, while the alternative position of the lever for the alternative form described above is shown in dotted outline at 82*a*.

Referring to FIG. 10, the rear of the back web 73 is formed to have the same shape as the inner face of the cover. Thus there are ribs 110, undercut at 111, similar to ribs 102 and undercuts 103 of the cover, and central rib 112, similar to rib 105 of the cover, with inclined upper surface 113. FIG. 10 illustrates these features and also two body parts 65 positioned to be assembled together by relative sliding, the ribs 110 engaging in the slots 100. A plurality of such body members can be assembled together, after assembly of contacts and actuator to each body part.

Both of the embodiments described above, and illustrated in the FIGS. 1 to 10 are of a form generally referred to as transfer switches. That is, electrical contact is transferred from one contact to another, by the lateral movement of the center contact. It is possible to provide other forms of switches by leaving out one of the outer contacts. Depending upon the form of the center contact, normally closed actuated to open, or normally open actuated to close switches can be provided.

FIGS. 11, 12 and 13 illustrate diagrammatically three forms of contact arrangement, with alternative actuating characteristics for each form. Thus considering FIG. 11 and FIG. 4, FIG. 11(*b*) is equivalent to the full line form of center contact 13, while FIG. 11(*a*) is equivalent to the dotted line form of the center contact. FIGS. 12(*a*) and 12(*b*) illustrate the arrangement with the center contact of FIG. 4 in the dotted line position and with the lower contact 14 omitted in FIG. 12(*a*) and with the top contact 12 omitted in FIG. 12(*b*). Similarly FIGS. 13(*a*) and 13(*b*) illustrate the arrangement with the center contact of FIG. 4 in the full line position, the top contact 12 omitted in FIG. 13(*a*) and the bottom contact 14 omitted in FIG. 13(*b*). FIGS. 11(*a*) and 11(*b*) are transfer switches, FIGS. 12(*a*) and 13(*a*) normally closed to open, and FIGS. 12(*b*) and 13(*b*) normally open to closed.

Relating the embodiment of FIGS. 7 to 10 to FIGS. 11, 12 and 13, FIGS. 11(*b*) would correspond to the arrangement of contacts as in FIG. 7, while FIG. 11(*a*) would correspond to the alternate form of the center contact 68. FIGS. 12(*a*) and 12(*b*) would correspond to the omission of the contact 69 in FIG. 7, again with the two alternative forms of center contact, and FIGS. 13(*a*) and 13(*b*) would correspond to the omission of the contact 67 in FIG. 7, once again with the two alternate forms of center contact.

In the switches as described and illustrated, it is possible to vary the actuation pressure by varying the contact point of actuator and contact extension. Thus the point of contact on the center contact extension 51, FIGS. 1 to 6, can be varied, as desired. This also varies the spring pressure. In the embodiment of FIGS. 7 to 10, the radial length of the rib 83 can be varied, to vary the position of actuation on the center contact.

What is claimed is:

1. A modular switch comprising:

an elongate hollow body member having a back and sides;

a plurality of cantilevered contacts in said body member, including a center contact and at least one side contact;

said center contact biased towards one of said sides of said body member;

an extension on said center contact; and an actuating member pivotally mounted on said closed end and extending along said body member, and including a lateral member extending across said open end, said lateral member positioned to engage said extension, whereby pivotting of said actuating member moves said center contact to change a switch condition of said switch.

2. A switch as claimed in claim 1, wherein said body member has a substantially U-shaped cross-section and includes an open end and a closed end; and further comprising a wedge-shaped member extending outwardly from said back and adjacent to said closed end, said wedge-shaped member having a base facing toward said open end and a thin edge facing toward said closed end, said center contact positioned selectively on one side of the wedge-shaped member to bias said center contact toward one of the sides of the body member.

3. A switch as claimed in claim 2, said actuator mounted on said closed end of said body member.

4. A switch as claimed in claim 1, said center contact including an extension extending out of said body member.

5. A switch as claimed in claim 4, said actuator including a member for engagement with said extension, movement of said actuator moving said center contact.

6. A switch as claimed in claim 1, said contacts including terminal portions extending through at least one side of said body member.

7. A switch as claimed in claim 2, including a plurality of pins extending outwardly from said back adjacent to said thin edge of said wedge-shaped member facing said closed end of said body member, two of said pins positioned on either side of a longitudinal axis passing through said thin edge of said wedge, said central contact extending between said two pins.

8. A switch as claimed in claim 7, said pins including a third pin positioned close to said closed end, for retention of a side contact, and two further pins extending forward from said back on either side of said wedge shaped member and adjacent to said base thereof, said pins positioned to locate said central contact against said wedge shaped member.

9. A switch as claimed in claim 1, including arcuate extensions on said sides, concave inner surfaces defining a bore at one end of said body member, said back extending to close said bore at one end; said actuator including a cylindrical body portion rotatable in said bore and an arcuate shroud spaced from said body portion and a close sliding fit over convex outer surfaces of said arcuate extensions.

10. A switch as claimed in claim 9, said body member including a base forming a closed end at an end opposite to said arcuate extensions, said contacts including terminal portions extending through at least one of said base and said sides, said center contact including an extension extending towards said bore, said actuator including a member for engagement with said extension.

11. A switch as claimed in claim 1, including a cover slidable on to said body member to form a front closing member.

12. A switch as claimed in claim 11, including a rib on each side of said cover and a groove in each side of said body member, said ribs engaging in said grooves when said cover is in position on said body member.

13. A switch as claimed in claim 12, said cover comprising a back of a further switch.

14. A switch as claimed in claim 12, including lateral extensions on an outer surface of said back, said extensions extending longitudinally and parallel to each other; a rib on an outer surface of each extension, said ribs adapted to engage in grooves in side members of a further switch.

15. A switch as claimed in claim 10, including a cover slidable on to said body member to form a front closing member, said cover including an extension to extend over front edges of said arcuate extensions.

16. A switch as claimed in claim 15, said sides having grooves formed in outer surfaces, said grooves extending parallel and adjacent to forward edges of said sides, said cover including ribs on each side of a rear face, said ribs spaced from said rear face and slidable in said grooves.

17. A switch as claimed in claim 15, said body member including ribs on each side of a rear face of the back of the body member, said ribs spaced from said rear face, said sides having grooves formed in outer surfaces, said grooves extending parallel to and adjacent to forward edges of the sides, said ribs on said rear face slidable in grooves in the sides of a further body member, and a cover member including ribs slidable in said grooves in said sides.

18. A switch as claimed in claim 17, said cover comprising the back of a further body member.

19. A switch as claimed in claim 1, the switch comprising one of a transfer switch, a normally closed switch and a normally open switch.

20. A modular switch comprising:

an elongated hollow body member having a back and sides, a substantially U-shaped cross-section, and an open end and a closed end;

a plurality of cantilevered contacts in said body member, including a center contact and at least two side contacts;

a wedge-shaped member biasing said center contact toward one of said sides of said body member, said wedge-shaped member extending outwardly from said back and adjacent to said closed end and having a base facing toward said open end and a thin edge facing toward said closed end, whereby said center contact is selectively positioned on one side of said wedge-shaped member to thereby bias said center contact toward one of said sides of said body member;

an extension on said center contact; and an actuating member rotatably mounted on said body member and engaging said extension;

whereby the rotation of said actuating member pivots said center contact to change a switch condition of said switch.

* * * * *

UNITED STATES PATENT AND TRADEMARK OFFICE

CERTIFICATE OF CORRECTION

PATENT NO. : 4,359,611

DATED : November 16, 1982

INVENTOR(S) : Steve W. Haskins

It is certified that error appears in the above—identified patent and that said Letters Patent is hereby corrected as shown below:

ON THE TITLE PAGE,

Kindly correct the effective date of the terminal disclaimer from "March 9, 1977" to --March 9, 1997-- in lines designated [*].

Signed and Sealed this

First Day of March 1983

[SEAL]

Attest:

GERALD J. MOSSINGHOFF

Attesting Officer

Commissioner of Patents and Trademarks